US007225773B2

(12) United States Patent
Schleusener et al.

(10) Patent No.: US 7,225,773 B2
(45) Date of Patent: Jun. 5, 2007

(54) VARIABLE STROKE VALVE DRIVE FOR AN INTERNAL COMBUSTION ENGINE

(75) Inventors: Michael Schleusener, Munich (DE); Ulrich Gutzer, Munich (DE); Christian Flenker, Zorneding (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 11/506,943

(22) Filed: Aug. 21, 2006

(65) Prior Publication Data

US 2007/0012269 A1 Jan. 18, 2007

Related U.S. Application Data

(63) Continuation of application No. PCT/EP2005/000199, filed on Jan. 12, 2005.

(30) Foreign Application Priority Data

Feb. 20, 2004 (DE) ..... 10 2004 008 389

(51) Int. Cl.
*F01L 1/34* (2006.01)

(52) U.S. Cl. ..... 123/90.16; 123/90.15; 123/90.31

(58) Field of Classification Search ..... 123/90.16, 123/90.15, 90.31
See application file for complete search history.

(56) References Cited

U.S. PATENT DOCUMENTS 4,572,118 A 2/1986 Baguéna
2003/0226530 A1* 12/2003 Werler ..... 123/90.16
2004/0144347 A1 7/2004 Schleusener et al.

FOREIGN PATENT DOCUMENTS

| | | |
|---|---|---|
| DE | 818 274 | 10/1951 |
| DE | 101 23 186 A1 | 11/2002 |
| DE | 102 35 400 A1 | 2/2004 |
| DE | 102 35 401 A1 | 2/2004 |
| DE | 102 35 403 A1 | 2/2004 |
| EP | 0 097 665 B1 | 11/1986 |
| EP | 1 255 027 B1 | 8/2004 |
| WO | WO 93/08377 A1 | 4/1993 |

OTHER PUBLICATIONS

International Search Report dated Apr. 19, 2005 with an English translation of the pertinent portion (Fourteen (14) pages).
German Search Report dated Oct. 6, 2004 with an English translation of the pertinent portion (Eight (8) pages).

* cited by examiner

*Primary Examiner*—Thomas Denion
*Assistant Examiner*—Zelalem Eshete
(74) *Attorney, Agent, or Firm*—Crowell & Moring LLP

(57) ABSTRACT

A variable stroke valve drive for an internal combustion engine, including an intermediate lever which is slidingly arranged on a crank path of a crank arm the intermediate lever has a working cam with null lifting cam and lifting cam portions. The working cam contacts a gas exchange valve via an intermediate element. A first adjustment element rotates the intermediate lever against a spring element around a point located near the crank, the intermediate lever being displaceable along the crank path by a second adjustment element. The first adjustment element is provided with a cam plate whose radius continuously increases or reduces on a circumference with respect to an axis of rotation. The inventive variable stroke valve drive substantially reduces wear in a valve drive.

16 Claims, 1 Drawing Sheet

VARIABLE STROKE VALVE DRIVE FOR AN INTERNAL COMBUSTION ENGINE

This application is a Continuation of PCT/EP2005/000199, filed Jan. 12, 2005, and claims the priority of DE 10 2004 008 389.4, filed Feb. 20, 2004, the disclosures of which are expressly incorporated by reference herein.

BACKGROUND AND SUMMARY OF THE INVENTION

The invention relates to a variable stroke valve drive for an internal combustion engine having an intermediate lower and a crank arm and cam arrangement for actuating the lever.

In German Unexamined Patent DE 101 23 186 A1, in which a mechanical regulating means for adjusting the lift of a gas exchange valve, a variable stroke valve drive of an internal combustion engine is described. The mechanical regulating means is characterized in that the rotational speed control and load control of the internal combustion engine are regulated not via a throttle valve but instead via the valve lift of the gas exchange intake valves. To achieve this, the mechanical regulating means has an intermediate lever which is mounted at one end so it is slidingly movable on a crank path of a crank arm and has a working cam with a null lifting cam and a lifting cam at the other end. The working cam is operatively connected here to a gas exchange valve via an intermediate element, namely a drag lever. Furthermore, the mechanical regulating means has a camshaft with which the intermediate lever is rotated against the elasticity of the restoring spring about a point near the crank arm, so that the portions between the null lifting cam and the lifting cam, which are operatively connected to the intermediate element, are shifted. Despite the rotating camshaft, the gas exchange valve remains closed as long as the contact point and/or the contact line is between the intermediate lever or the null lifting cam and a rolling element arranged on this intermediate lever. Furthermore, the mechanical regulating means has a second adjusting element, namely an eccentric shaft, which acts on the intermediate lever near the crank arm. Due to the rotation of the eccentric shaft, the intermediate lever in the crank arm is shifted parallel to the crank path so that the effective component between the lifting cam and the no-load lifting cam is altered. The portion of the lifting cam with respect to the cam elevation may thus be increased or decreased. An increase in the lifting cam portion corresponds to an increase in the gas exchange valve lift. A reduction in the lifting cam portion corresponds to a reduction in the gas exchange valve lift until as described above, only the no-load lifting cam portion is operatively connected to the intermediate lever.

One disadvantage of the embodiment described here is the relatively high wear on the intermediate lever on all contact areas with corresponding friction partners such as the restoring spring, the crank arm, and the drag lever.

The object of the present invention is to provide a generic variable stroke valve drive with minimized wear.

This object is achieved through the features in the by using instead of a camshaft, a cam plate whose radius increases or decreases steadily over the circumference with respect to the axis of rotation.

In the state of the art described above, the camshaft has a base circle, i.e., a circumferential area of the cam with a constant radius. As long as the base circle of the camshaft is operatively connected to the intermediate lever, the intermediate lever remains at rest, i.e., it is not rotated. Due to the fact that it is stationary, there is a transition from adhesion to sliding on the contact areas of the intermediate lever with a spring element, the intermediate element and the crank arm in the transition from the base circle of the cam to the cam elevation, thus resulting in heavy wear on the contact areas.

With an embodiment of the present invention, however, the intermediate lever is kept permanently in motion with rotation of the inventive cam plate. Due to the constant motion of the intermediate lever, tangential excitation of the spring element due to breakaway is prevented, while avoiding the high acceleration forces that are transmitted via the contact points, at which unfavorable lubrication conditions prevail due to a static surface pressure. In other words, through the proposed constant vibrational movement of the intermediate lever when using a cam plate in an advantageous manner is there a constant oil input between the contact areas of the contact partners, consisting of the intermediate lever, the spring element and the intermediate element. Thus the fictional losses and the component wear are greatly reduced and the lifetime of the variable stroke valve drive is greatly prolonged. Secondly, the intermediate lever rotational accelerations due to the uninterrupted rotational movement are greatly reduced, so the gas exchange valves can be opened more quickly and the charge cycle, as well as processing of the mixture, are improved. Thirdly, resonance effects of the restoring spring are ruled out due to constant active leg lengths, such as those which occur with a stationary intermediate lever in contact with the base circle, and the variable stroke valve drive is more stable mechanically, i.e., is less susceptible from the standpoint of vibration technology. Furthermore, as a result of this, the spring element may be designed with smaller dimensions, so that much higher rotational speeds can also be achieved in conjunction with the reduced acceleration forces of the intermediate lever, as described previously.

Due to the inventive use of the cam plate, the variable stroke valve drive thus becomes much more resistant to wear and more stable mechanically, i.e., there are reduced acceleration forces and vibrational forces, thereby reducing technical vibration problems and allowing the rotational speed of the internal combustion engine to be increased with no problem.

Through support of the intermediate lever on the crank path via a roller element, the internal friction in the entire variable stroke valve drive is reduced again significantly. Due to the proposed embodiment, wear is thus further reduced and the lifetime and/or service life is increased. Fuel savings due to the reduced internal friction of the variable stroke valve drive can be mentioned as another positive effect.

Further, through arrangement of the crank path as an arc of a circle, a purely rotational movement of the intermediate lever is possible in operation of the second adjusting device. The fulcrum here is the point near the crank arm and thus when using the first roller element this is the axis of rotation of the first roller element. There are no translational movements and thus sliding movements, which are associated with wear. Furthermore, spontaneous (i.e., without delay) opening and closing of the gas exchange valve are possible.

With an embodiment in which the base circle of a camshaft is simulated, a closed gas exchange valve is made possible without resulting in the aforementioned disadvantages of a traditional known camshaft.

An embodiment in which the ramp between the null lifting cam and the lifting cam is integrally molded reduces the acceleration forces that occur in the variable stroke valve drive in the transition from the no-load lifting cam to the lifting cam. The resulting constant opening and closing accelerations of the intermediate lever allow a higher rotational speed of the internal combustion engine.

With an intermediate element configured as a swing lever or a tilt lever, the variable stroke valve drive is largely free of play and maintenance. A hydraulic valve play equalizing element is preferably used.

An embodiment in which the inventive variable stroke valve drive crank arm is located in a cylinder head allows a compact and stiff design of the variable stroke valve drive.

Using a second adjusting device, the forces and/or torques to be applied in adjusting the gas exchange valve lift can be achieved with no problem. Of course the cam plate may have any technically feasible contour.

Other objects, advantages and novel features of the present invention will become apparent from the following detailed description of the invention when considered in conjunction with the accompanying drawings.

DETAILED DESCRIPTION

Figure 1:
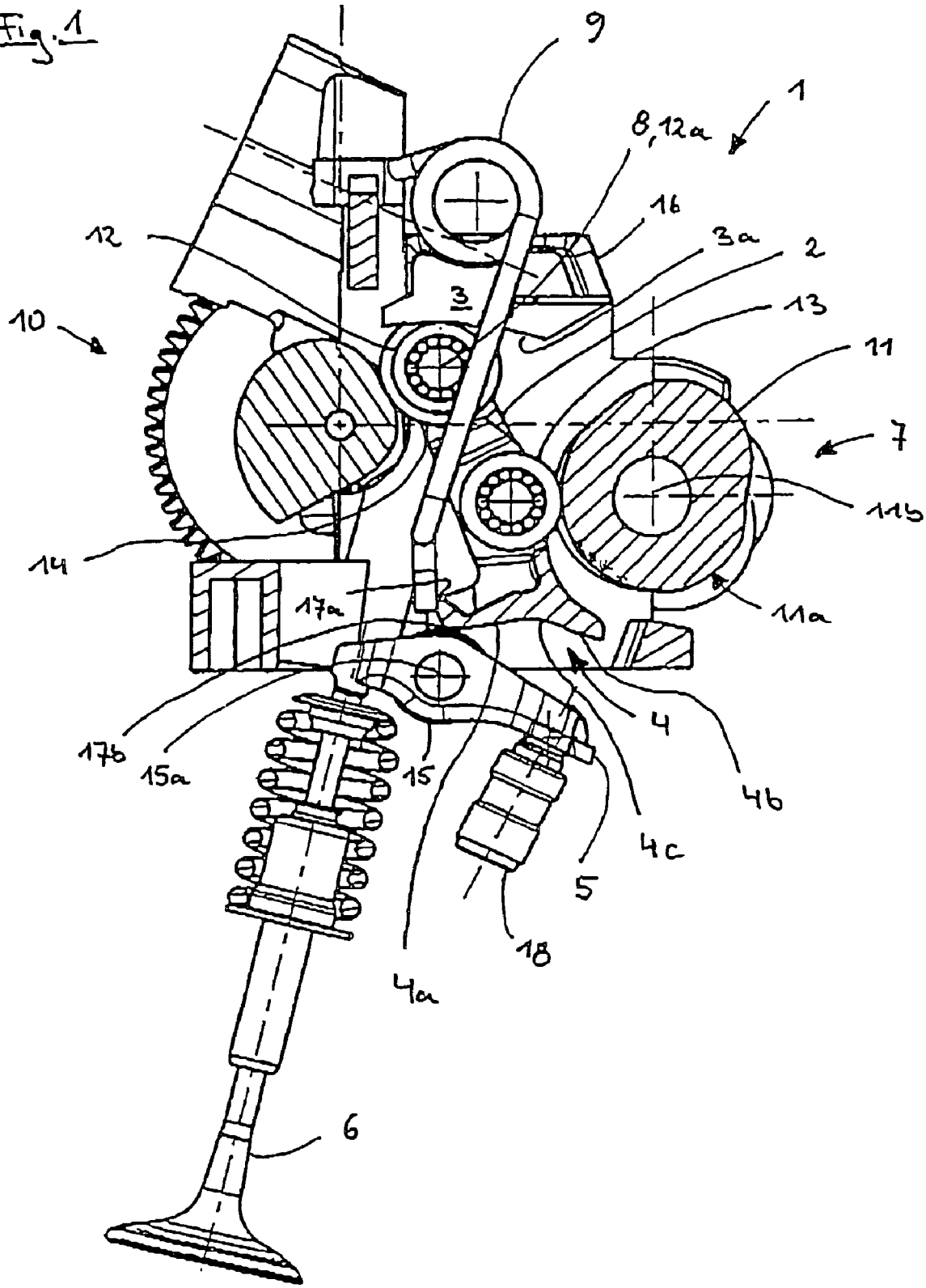
FIG. 1 shows a section through an variable stroke valve drive in accordance with an embodiment of the present invention.

The variable stroke valve drive 1 includes an intermediate lever 2 which is mounted at one end so it is slidingly movable on a crank path 3*a* of a crank 3 which is arranged in a stationary mount in a cylinder head 16. On the opposite end, the intermediate lever 2 has a working cam 4 with a null lifting cam 4*a* and a lifting cam 4*b*, a ramp 4*c* being formed between the null lifting cam 4*a* and the lifting cam 4*b*. In FIG. 1, the null lifting cam 4*a* is operatively connected to a fourth roller element 15, a roller of an intermediate element 5, a drag lever. The operative connection is a linear contact between the roller and the working cam 4, which is largely planar in a plane perpendicular to the plane of the drawing. The intermediate lever 5 is mounted at one end on a play equalizing element 18, preferably a hydraulic valve play equalizing element and on a gas exchange valve 6 at the other end. The gas exchange valve 6 and the play equalizing element 18 are mounted in the cylinder head 16. The crank path 3*a* has a defined radius. An axis of rotation 15*a* of the fourth roller element 15 is the center of curvature of the crank path 3*a* when the null lifting cam 4*a* and the fourth roller element 15 are operatively interconnected.

On the crank end, the intermediate lever 2 has a first roller element 12 with a first axis of rotation 12*a*, which is also in linear contact with the crank path 3*a* perpendicular to the plane of the drawing. A second roller element 13 is arranged coaxially with the first axis of rotation 12*a* and is operatively connected to a second adjusting device 10. The second adjusting device 10 in the present exemplary embodiment has a cam plate with which the crank end of the intermediate lever 2 can be shifted in parallel to the crank path 5*a* in a controlled or regulated manner. For example, the cam plate may be an eccentric plate or cam but any other contours may also be used without any problem.

Approximately in the middle between the first and second roller elements (12, 13) and the working cam 4, the intermediate lever 2 has a third roller element 14. A first adjusting device 7 acts on this third roller element 14. The first adjusting device 7 includes a cam plate 11 with a circumferential surface 11*a*, which rotates about an axis of rotation 11*b*. The cam plate 11 has a radius that changes steadily over the circumferential surface 11*a* and thus differs from a camshaft due to the lack of a base circle, i.e., a circumferential surface section 11*a* having a constant radius.

The gas exchange valve 6 is opened and closed cyclically with the first adjusting device 7, and in addition to the null lifting cam 4*a*, the lifting cam 4*b* is also operatively connected to the fourth roller element 15. The absolute lift of the gas exchange valve 6 is set with the second adjusting device 10. If the linear contact (contact area 17*a*) of the fourth roller element 15 is on the null lifting cam 4*a*, then the gas exchange valve lift is zero, the linear contact over the ramp 4*c* is shifted to the working cam 4*b*, so the lift of the gas exchange valve 6 is increased to a maximum. To implement null lifting with the null lifting cam 4*a*, its contour is largely shaped as a circular section, This ensures that the first adjusting device 7 is always operatively connected to the intermediate element 2 via the third roller element 14, so a spring element 9, a leg spring, is provided and is attached in a stationary attachment to the cylinder head 16 and always presses against the intermediate lever 2 with a first contact area 17*a* close to the working cam 4. Of course other contact points may also be provided on the intermediate element 2.

The exemplary section here through a preferred embodiment of the variable stroke valve drive 1 shows a section of a single gas exchange valve 6 of the internal combustion engine. The gas exchange valve 6 may be an intake gas exchange valve as well as an exhaust gas exchange valve. Furthermore, the internal combustion engine may have several gas exchange valves 6 for the intake and/or exhaust ends per cylinder. This means that the variable stroke valve drive may be used on both the intake end and the exhaust end. The number of cylinders of the internal combustion engine has no direct influence on the function of the variable stroke valve drive 1. By combining multiple devices 7, 10, e.g., by using one shaft for several cam plates 11, a variable stroke valve drive 1 may be provided for each intake side and/or exhaust side of a cylinder bank.

The play equalizing element 18, which in the present exemplary embodiment is a hydraulic equalizing element, may also be implemented by other design variants, e.g., mechanical equalizing elements. Furthermore, the intermediate element 5 may be a tilt lever, for example, instead of a swing lever. The intermediate element 5 may be either in direct contact with the working cam 4, in which case the surface near the intermediate element is to be shaped with a radius, or the contact is accomplished via the fourth roller element 15. The second adjusting device 10 may also be a pusher rod adjustment and/or a hydraulic or electromechanical adjusting device in addition to being an eccentric adjustment. The spring element 9, which is a leg spring in the present exemplary embodiment, may also be replaced by spring elements having a different geometric design, e.g., a plate spring. The roller elements 12 through 15 are preferably ball mounted or needle mounted and a friction bearing is also possible. The intermediate lever 2 is preferably made of sheet metal or manufactured by a casting method. The crank 3 may be detachably or nondetachably connected to the cylinder head 16.

During operation of the internal combustion engine, the cam plate 11 of the first adjusting device 7 is rotated about the axis of rotation 11*b* in largely phase-locked manner with a crankshaft. However, to be able to completely take advantage of the fuel savings of the variable stroke valve drive, a camshaft adjusting unit, for example, may be provided, varying the relative rotational position of the first adjusting device 7 in relation to the crankshaft rotational position within certain limits. Due to the rotational movement of the first adjusting device 7, the intermediate lever 2, which is pressed by the spring element 9 against the cam plate 11, is rotated about the point 8 near the crank. If the first roller element 12 is omitted, the point near the crank arm then drifts. If the first roller element 12 is used, then the midpoint of rotation (point 8 near the crank) of the intermediate lever 2 is the midpoint of the first roller element 12, which advantageously does not drift in rotation of the intermediate lever 2. The working cam 4 here does not drift in this way. The working cam 4 here is shifted over the fourth roller element 15 in the second contact area 17*b*. As long as the second contact area 17*b* is in the vicinity of the null lifting cam 4*a*, there is no movement of the gas exchange valve. If the second adjusting device 10 is adjusted and the first roller element 12 is shifted in the direction of the arrow, the second contact area 17*b* migrates over the ramp 4*c* into the vicinity of the lifting cam 4*b*. In this case, the gas exchange valve 6 is opened and then closed again.

When using a camshaft for the first adjusting device 7, as described in the state of the art, the intermediate lever 2 stands still when the base circle of the camshaft is operatively connected to the third roller element 14. In this period of time, lubricant is forced out of the contact areas 17*a*, 17*b* in particular due to the static surface pressure. As the cam is raised, the intermediate lever 2 is pivoted again and in the first moment of movement there is dry friction and/or mixed friction in the contact areas 17*a*, 17*b*. Due to this initial dry and/or mixed lubrication, there is enormous wear, which is prevented with the present invention.

The feature essential the present invention is explained again below with its essential advantages.

Due to the use of the inventive cam plate 11, the intermediate lever 2 is always in motion so there cannot be any static surface pressure in the contact areas 17*a*, 17*b* and constantly adequate lubrication of the contact areas 17*a*, 17*b* is ensured at all times. The inventive design thus results in much less friction and much less wear. In addition, the opening and closing accelerations of the intermediate lever are greatly reduced due to the use of the cam plate 11, so that much higher rotational speeds of the internal combustion engine are possible. Another advantage is the possibility of smaller dimensions of the spring element 9. Furthermore, resonance effects in the spring element 9 due to the constant movement of the intermediate lever 2 are avoided. By optimizing the spring element 9, higher rotational speeds can again be achieved while at the same time minimizing friction and minimizing wear.

The foregoing disclosure has been set forth merely to illustrate the invention and is not intended to be limiting. Since modifications of the disclosed embodiments incorporating the spirit arid substance of the invention may occur to persons skilled in the art, the invention should be construed to include everything within the scope of the appended claims and equivalents thereof.

List of Reference Notation

1. Variable stroke valve drive
2. Intermediate lever
3. Crank arm
3*a*. Crank path
4. Working cam
4*a*. Null lifting cam
4*b*. Lifting cam
4*c*. Ramp
5. Intermediate element
6. Gas exchange valve
7. First adjusting device
8. Point near crank
9. Spring element
10. Second adjusting device
11. Cam plate
11*a*. Circumferential surface
11*b*. Axis of rotation
12. First roller element
12*a*. First axis of rotation
13. Second roller element
14. Third roller element
15. Fourth roller element
15*a*. Second axis of rotation
16. Cylinder head
17*a*. First contact area
17*b*. Second contact area
18. Play equalizing element

What is claim is:

1. A variable stroke valve drive for an internal combustion engine, comprising:

an intermediate device for actuating a gas exchange valve;

an intermediate lever having a working cam with a null lifting cam and a lifting cam, wherein the intermediate lever is mounted on a crank path of a crank arm so that the lever is slidingly movable and the working cam operatively engages the intermediate element for gas exchange valve actuation;

a first adjusting device for rotating the intermediate lever about a point near the crank arm against a spring force of a spring element; and a second adjusting device, wherein the intermediate lever is displaceable with the second adjusting device along the crank path, wherein the first adjusting device has a cam plate, the radius of which increases or decreases steadily over a circumference with respect to an axis of rotation of the cam plate.

2. The variable stroke valve drive as claimed in claim 1, wherein the intermediate lever is supported on the crank path via a first roller element.

3. The variable stroke valve drive as claimed in claim 2, wherein the first roller element is situated on the intermediate lever.

4. The variable stroke valve drive as claimed in claim 3, wherein the first adjusting device is operatively connected to the intermediate lever via a second roller element.

5. The variable stroke valve drive as claimed in claim 4, wherein the second roller element is situated on the intermediate lever.

6. The variable stroke valve drive as claimed in claim 5, wherein the second adjusting device is operatively connected to the intermediate lever via the first roller element or a third roller element.

7. The variable stroke valve drive as claimed in claim 6, wherein the third roller element is arranged on the intermediate lever.

8. The variable stroke valve drive as claimed in claim 7, wherein the intermediate element is operatively connected to the working cam at a second contact area.

9. The variable stroke valve drive as claimed in claim 8, wherein the intermediate element has a fourth roller element which is operatively connected to the working cam on the second contact area.

10. The variable stroke valve drive as claimed in claim 9, wherein the crank path is an arc of a circle.

11. The variable stroke valve drive as claimed in claim 10, whereby the fourth roller element has an axis of rotation, wherein the axis of rotation is a center of curvature of the crank path when the null lifting cam is operatively connected to the fourth roller element.

12. The variable stroke valve drive as claimed in claim 11, wherein the null lifting cam is shaped as an arc of a circle.

13. The variable stroke valve drive as claimed in claim 12, wherein a ramp is integrally formed between the null lifting cam and the lifting cam.

14. The variable stroke valve drive as claimed in claim 13, wherein the intermediate element is a swing lever or a tilt lever.

15. The variable stroke valve drive as claimed in claim 1, wherein the internal combustion engine has a cylinder head, wherein the crank arm is situated in the cylinder head.

16. The variable stroke valve drive as claimed in claim 1, wherein the second adjusting device has a second cam plate.

* * * * *